United States Patent [19]

Eckert

[11] Patent Number: 4,792,431

[45] **Date of Patent: * Dec. 20, 1988**

[54] PRODUCTION OF INTERMETALLIC PARTICLES

[75] Inventor: Charles E. Eckert, Plum Boro, Pa.

[73] Assignee: Aluminum Company of America, Pittsburgh, Pa.

[ * ] Notice: The portion of the term of this patent subsequent to Aug. 25, 2004 has been disclaimed.

[21] Appl. No.: 90,825

[22] Filed: Aug. 25, 1987

Related U.S. Application Data

[63] Continuation-in-part of Ser. No. 812,982, Dec. 24, 1985, Pat. No. 4,689,199, which is a continuation of Ser. No. 654,736, Sep. 27, 1984, abandoned.

[51] Int. Cl.[4] ..... C22C 1/00

[52] U.S. Cl. ..... 420/590; 75/10.19

[58] Field of Search ..... 420/129, 590; 75/10.19, 75/10.21; 219/121 PY

[56] References Cited

U.S. PATENT DOCUMENTS

| | | | |
|---|---|---|---|
| 3,137,753 | 6/1964 | Feichtinger | 420/590 |
| 3,268,326 | 8/1966 | Harders | 420/590 |
| 3,340,020 | 9/1967 | Neuenschwander et al. | 23/349 |
| 3,729,309 | 4/1973 | Kawawa | 75/129 |
| 3,768,999 | 10/1973 | Ohkubo et al. | 75/58 |
| 3,858,640 | 1/1975 | Sifferlen | 164/250 |
| 3,947,265 | 3/1976 | Guzowski et al. | 75/10 R |
| 4,688,771 | 8/1987 | Eckert et al. | 266/78 |
| 4,689,199 | 8/1987 | Eckert et al. | 420/590 |

FOREIGN PATENT DOCUMENTS

| | | | |
|---|---|---|---|
| 802133 | 12/1968 | Canada | 53/344 |

*Primary Examiner*—Christopher W. Brody
*Attorney, Agent, or Firm*—Carl R. Lippert

[57] ABSTRACT

A method of producing intermetallic particles such as $TiAl_3$, $NiAl_3$ and others utilizes a chamber having a discharge immersed in molten media such as molten metal and having a plasma therein extending from the molten media at the chamber discharge to a site above the discharge. One or more constituents of the desired compound are provided to said site and converted into a superheated spray. The constituents react with each other or with one or more constituents in the aforesaid media to produce the desired compound. A gas exits the chamber and enhances contact and reaction and also transfer to the media.

21 Claims, 2 Drawing Sheets

PRODUCTION OF INTERMETALLIC PARTICLES

BACKGROUND OF THE INVENTION

This application is a continuation-in-part of U.S. Ser. No. 812,982 filed Dec. 24, 1985 now U.S. Pat. No. 4,689,199 which, in turn, is a continuation of abandoned U.S. Ser. No. 654,736, filed Sept. 27, 1984.

This invention relates to forming intermetallic compound particles in a molten media such as molten metal. The particles can be left in the media as alloying or reinforcing material or can be separated.

Many different methods have been employed to add alloying elements to molten metals. Conventional methods typically add the elements directly to the melt in the form of a lump, a bar or the like. In some cases, they are added directly to molten metal being tapped into a ladle, and in other cases, they may be placed in the ladle prior to tapping.

Another method for adding alloying elements to molten metals, particularly molten steel, is disclosed in U.S. Pat. No. 3,768,999 to Ohkubo et al. In Ohkubo, alloying is accomplished by feeding a wire rod into the molten metal. The rod is coated with additives for the molten metal and an organic binder which decomposes into gaseous products in the molten metal. The generated gas stirs the molten metal and thus uniformly incorporates the added components throughout the molten metal.

U.S. Pat. No. 3,729,309 to Kawawa also discloses a method for adding alloying elements in the form of a wire rod to molten metals. The rod has a controlled size and is added to a molten metal bath by inserting it at a controlled speed, so as to produce a refined and purified metal alloy.

The above methods of adding alloying elements to molten metal work fairly well with alloying elements which dissolve, melt or disperse easily in the molten metal. However, such methods do not work as well with elements having limited liquid solubility such as Pb, Bi and Sn or readily high oxidized elements such as Mg and Zn.

U.S. Pat. No. 3,947,265 to Guzowski et al proposes a solution to the problem of adding such "hard-to-alloy" materials to molten metal. The process employs a high current arc which is formed between the molten base metal and the alloying addition. The alloying addition is passed through the arc where it is melted and converted into a spray of finely divided superheated molten particles. In such a condition, the particles are able to rapidly dissolve in the molten metal upon contact therewith. While the Guzowski concept of alloying is certainly an interesting one, a need still exists for a process capable of providing improved results.

Accordingly, an object of the present invention is to provide an improved process for adding "hard-to-alloy" alloying materials to molten metals.

Another object of the present invention is to provide an alloying process having high dissolution rates.

Another object of the present invention is to provide an alloying process which is amenable to continuous casting processes.

Another object of the present invention is to provide a lead alloyed, aluminum based metal article having high machinability.

Another object of the present invention is to provide a process for adding alloying material to a molten media that additionally adds heat to the molten media.

Additional objects and advantages of the present invention will become apparent to persons skilled in the art from the following specification and drawings.

SUMMARY OF THE INVENTION

In accordance with the present invention, a method is provided for adding alloying material to a molten metal media, such as molten aluminum. The method includes the step of converting the alloying material into a spray of superheated alloy material and directing the spray into the molten metal media at a predetermined depth below the media's surface, the depth having been determined beforehand to enhance dissolution and dispersion of the alloying material into the molten media.

In a preferred embodiment, the alloying material is converted into the spray of superheated alloy material in a chamber or spark cup means which is at least partially immersed in the molten media body. The spark cup has a lower open end which is exposed to the molten media and an upper inlet, at least a portion of which is located above the exposed or exterior surface of the molten media. The lower open end of the spark cup is maintained or immersed a predetermined depth below the surface of the molten media. The alloying material, preferably in the form of an elongated element having a free end, is continually fed into the spark cup through its upper inlet, and an electrical arc discharge between the submerged molten metal surface and the alloying element in the spark cup is maintained with a current that exceeds the globular/spray transition current density of the alloying material. At such a current, the free or exposed end of the alloying element is converted into a spray of superheated material. An ionizable gas is continually supplied to the spark cup through its upper inlet also. In addition to shielding the arc discharge, the gas slightly pressurizes the spark cup and thereby prevents molten media from entering its open end. As such, a submerged interior surface of molten metal media is created in the spark cup's open end at the aforementioned predetermined depth. The shielding gas also carries or projects the superheated spray of alloy material into the molten media through the submerged molten metal surface so as to permit dissolution and dispersion of the alloy material in the media. The predetermined depth of immersion has been found to significantly enhance dispersion and dissolution of the alloying material into the media.

The present invention also provides a lead alloyed, aluminum based article having high machinability. The article is produced by converting lead alloy material into a spray of superheated alloy material which is injected into a bath of molten aluminum at a predetermined depth below the molten bath's surface. The spray is formed by establishing an electrical arc discharge between a submerged surface of the molten media and the alloying material. The discharge is maintained with a current that exceeds the globular/spray transition current density of the alloying material. The spray of superheated alloying material is directed onto the submerged interior surface of the media where dissolution and dispersion of the alloy material into the media take place. The submerged surface is maintained at the predetermined depth below the bath's surface having been found to enhance said dissolution and dispersion of the lead into molten aluminum bath. The article so produced has acicular shaped particles of lead which are smaller and more uniformly sized and dispersed than those which are made by adding lead at the surface of the molten aluminum or at a depth above the aforesaid predetermined depth.

DETAILED DESCRIPTION OF A PREFERRED EMBODIMENT

Figure 2:
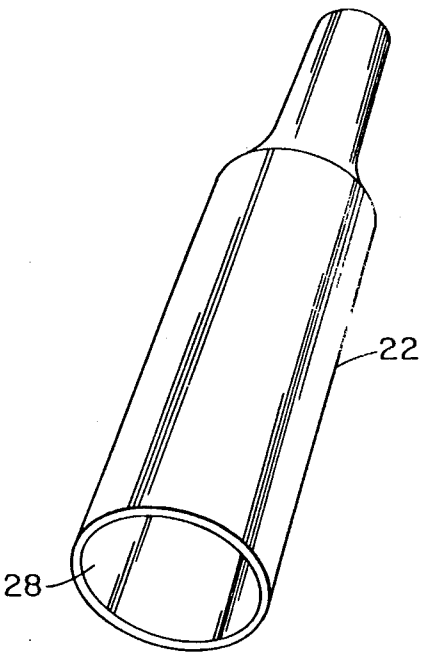
FIG. 2 illustrates the spark cup depicted in FIG. 1.
Figure 1:
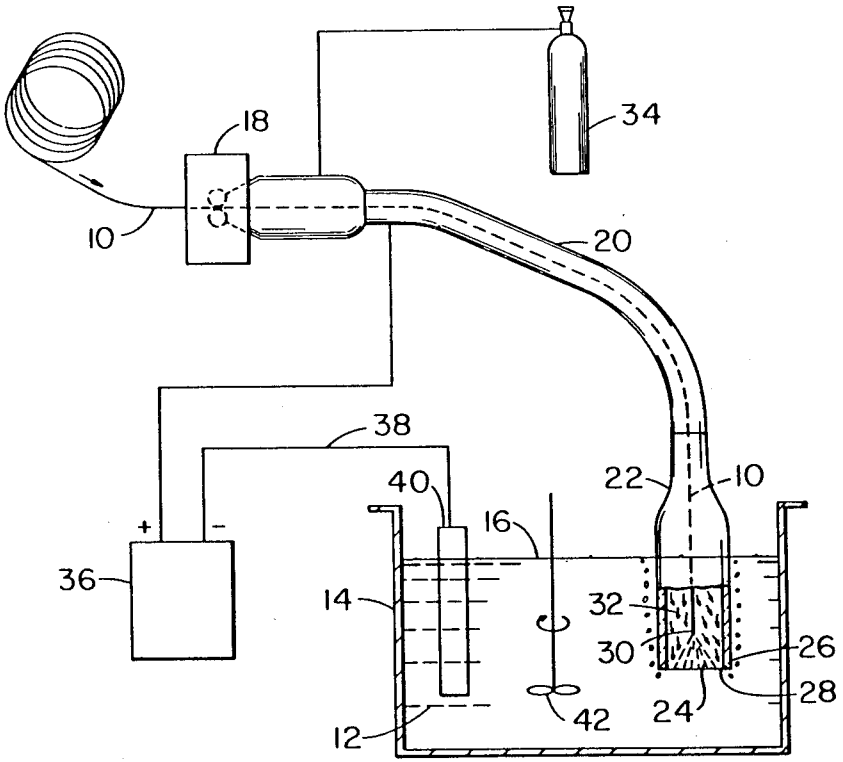
FIG. 1 illustrates an embodiment of the present invention.

FIG. 1 illustrates the addition of a wire 10 of alloying material into a bath or melt 12 of molten media in a flow-through furnace 14. The surface of melt 12 is referred to herein as exposed or exterior surface 16. Wire 10 is being fed by a feeder 18 which passes it through a triplex feed cable 20 into a spark cup 22, the spark cup being partially immersed in melt 12. In spark cup 22, alloy wire 10 is converted into a spray 24 of superheated alloy material by passing it through a plasma arc discharge (not numbered). The plasma arc discharge is established between a submerged surface 26 of the molten metal which is maintained within an open end 28 (see FIG. 2) of spark cup 22 and a free end 30 of alloy wire 10. The arc discharge is shielded with a shielding gas 32, preferably argon, which is provided via feed cable 20 by an arc shielding gas source 34. In addition to providing a shielding atmosphere for the arc in the spark cup, the shielding gas source 34 pressurizes the spark cup at a pressure which is sufficient to prevent molten metal from entering open end 28 of the spark cup. Such pressurization also facilitates maintenance of the aforementioned submerged surface at a certain predetermined depth below exposed surface 16 (more on this, infra). Returning to FIG. 1, it will be seen that the arc discharge is powered by a constant current power supply source 36 (more on this, infra). Melt 12 serves as an anode with wire 10 serving as a consumable electrode. The electrical circuit leading back to current source 36 is completed by a return wire 38 which is attached to a rod 40 immersed in melt 12. The superheated spray produced by the arc discharge is directed or projected by the supply of shielding gas onto submerged surface 26 where the alloy material rapidly dissolves and disperses in melt 12. The gas is preferably supplied at a flow rate that maximizes the projection of the spray into the melt. An impeller 42 or agitating means is also provided to further enhance dispersion of the alloy material throughout the melt. Spray 24 can be maintained as long as is desired by continually advancing or feeding the alloying wire into the spark cup. Feeder 18 can also be controlled to maintain or vary the rate at which wire 10 is fed into the spark cup.

The alloying material can be provided in wire form, as described above, or in the form of rod, tube, strip or in powdered form wherein the powders are encased in a hollow tube made from a suitable metal which has been swaged or otherwise worked to reduce its diameter and compact the powdered material in the tube. The only real limitation on the form of the alloying is that it should have a form which permits it to be fed into the feed cable in a seal-tight fashion, thereby enabling the pressurized atmosphere in the spark cup to be maintained. If the pressurized atmosphere in the spark cup is not maintained, molten metal will, quite obviously, enter the spark cup through its open end 28, thereby raising submerged surface 26 to a depth above its predetermined depth. Such raising of submerged surface 26 will result in lower dissolution and dispersion rates. (The importance of maintaining submerged surface 26 at its predetermined depth will be discussed in more detail, infra.) While no means for sealing the wire is depicted in FIG. 1, those skilled in the art will be aware of numerous means having the capability of providing an effective seal. Such means could include elastomer and pneumatic seals. In addition, feeder 18 is preferably a consistent feed rate tractor drive.

Constant current source 36 is preferably of the type which maintains a relatively constant current regardless of voltage fluctuations. The arc produced thereby has self-stabilizing characteristics and is relatively insensitive to changes in arc length which might be caused by fluctuations in the submerged molten metal depth. It may also be desirable in certain situations to further enhance arc stability by seeding the plasma discharge with certain additives, such as alkali metals which are known to promote arc stability. Arc stability can also be enhanced by using various fluxes known to those skilled in the relevant art.

As mentioned in U.S. Pat. No. 3,947,265 to Guzowski, it may be desirable to add a high frequency, high voltage component to the arc which is particularly useful if AC current is used. This apparently reduces the tendency of the arc to extinguish every time the voltage passes through zero, increases the stability of the arc and makes initiation of the arc less difficult.

An important aspect of the present invention requires that the current supplied by power source 36 exceed the globular/spray transition current density of the alloyed material. As used herein, the globular/spray transition current density defines the boundary line separating the two different types of metal transfer that are capable of occurring in the plasma arc discharge. (As pointed out by Guzowski in U.S. Pat. No. 3,947,265, this transition point can vary with such factors as alloy type, wire size and wire speed.) In cases with current densities below the transition point, alloy material being transferred through the arc detaches into large drops which dissolve and disperse slowly in the molten metal media. At current densities above the transition point, the transfer mechanism changes causing the alloy material to convert a fine spray of superheated alloy material. In this condition, the alloy material rapidly dissolves and disperses in the molten media upon contact with submerged surface 26.

Shielding gas 32 carrying or projecting spray 24 into the melt also typically enters the melt. This, however, should not introduce or cause any melt contamination since such gas simply escapes from the melt by bubbling through the melt to exterior surface 16. As previously mentioned, the preferred shielding gas is argon; however, other shielding gases, such as helium, carbon monoxide and carbon dioxide, may also be used in appropriate situations.

The spark cup is preferably cylindrically shaped. Such a shape provides a relatively high spark cup surface area to volume ratio which facilitates conductive heat transfer from the spark cup to the melt. It is important to facilitate such heat transfer to prevent the spark cup from overheating. Moreover, those skilled in the relevant art will appreciate that such heat transfer to the melt is advantageous in that it provides a convenient way of adding heat to the melt, thereby reducing furnace fuel needs. Conventional alloy adding processes such as that disclosed in Guzowski et al U.S. Pat. No. 3,947,265 do not add much, if any, heat to their respective melts. For example, most of the heat generated during melting of the alloy material in Guzowski et al is lost to the atmosphere since the superheated spray is formed entirely above the melt surface.

The spark cup's cylindrical shape also enhances projection of the shielding gas carrying the superheated spray into the melt. Such projection is important in that it enhances dissolution and dispersion of the alloying material into the melt. While a cylindrical shape is preferred, other shapes, such as an inverted frustoconical shape, which provide enhanced projection and heat transfer are considered to be within the purview of the present invention.

The spark cup's composition is another important aspect of the present invention. Preferably, it is made from material having the following characteristics:

1. High radiation heat transfer so as to maximize the transfer of radiation heat from the arc discharge to the melt, thereby reducing the possibility of overheating in the spark cup.

2. High resistance to thermal and mechanical shock.

3. High thermal and chemical stability in the melt.

Borosilicate, alumina, mullite and silica are some materials known to possess the desired characteristics.

Figure 4:
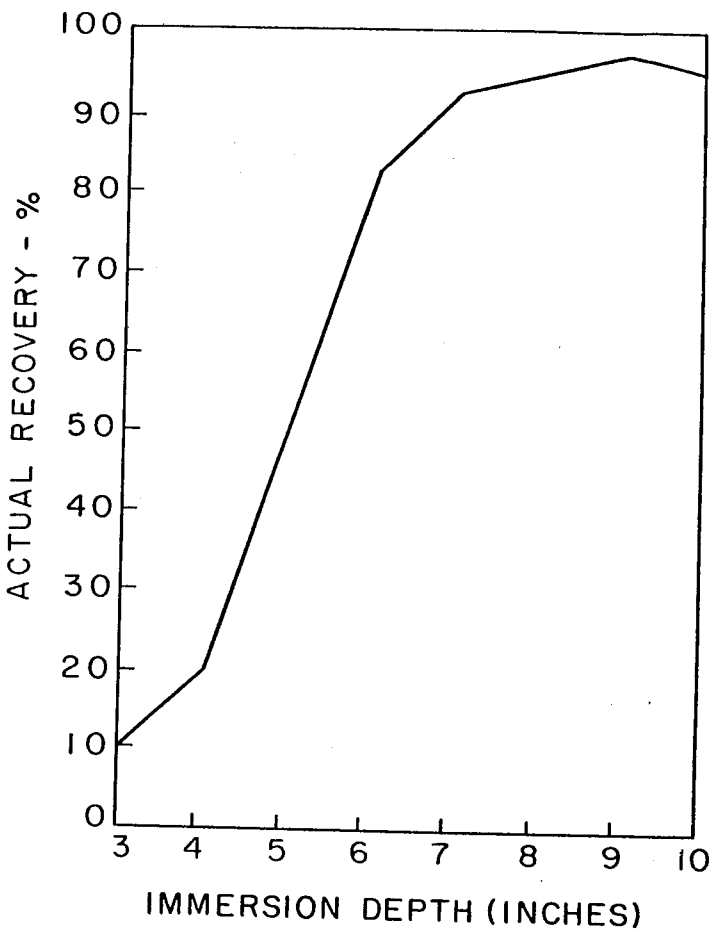
FIG. 4 is a graph illustrating the relationship of actual recovery in percentages versus immersion depth in inches.
Figure 3:
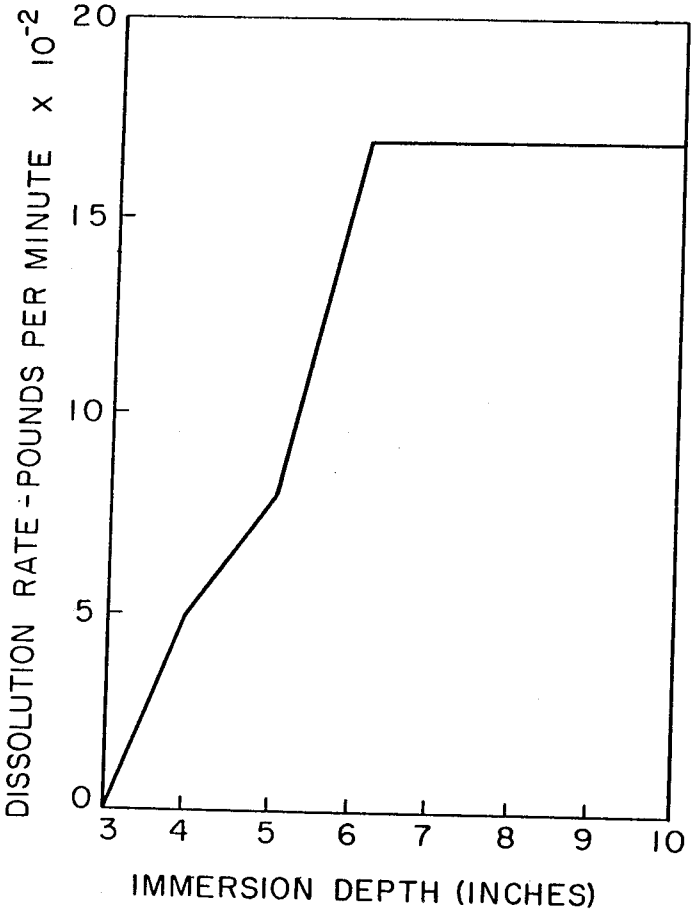
FIG. 3 is a graph plotting alloy dissolution rate in pounds per minute versus spark cup immersion depth.

Another briefly alluded to but important aspect of the present process invention is directed to immersing the spark cup and maintaining submerged surface 26 in the open end of the spark cup at its predetermined depth below exposed surface 16. Such depth will be referred to hereinafter as the predetermined immersion depth. It has been found that a difference of one or two inches in the immersion depth can have a significant impact upon the rate at which alloying material dissolves and disperses in the molten media. FIGS. 3 and 4 set forth test data from experiments conducted to determine the effects of immersion depth upon dissolution and dispersion. FIG. 3 sets forth data respecting dissolution rate in pounds per minute versus immersion depth, and FIG. 4 shows actual recovery in percentages versus immersion depth. The goal of the experiments was to add 0.5% lead to a substantially lead-free body of molten aluminum. The experiments were conducted with a setup similar to that disclosed in FIG. 1 except that a constant voltage supply source was used instead of the preferred constant current supply source. The flow-through furnace used in the experiments contained approximately 1000 pounds of aluminum. The bath of molten aluminum in the furnace had a depth of approximately 30 inches with a diameter of approximately 23 inches. One-eighth inch diameter lead wire was fed into a borosilicate spark cup at a feed rate of about 30 inches per minute via a triplex feed cable. The spark cup was cylindrically shaped and had a lower opening similar to that described in FIG. 1 with a diameter of approximately five centimeters. The spark cup's length to diameter ratio was approximately 6 to 1. Argon shielding gas was fed into the spark cup via the feed cable at a flow rate of about 10 standard $ft^3$/hr. A plasma arc discharge was established in the spark cup between the free end of the lead wire and the submerged molten metal surface at a voltage of about 35 volts and a current of about 125 amperes, which translates into a current density of about 10,000 amp/$in^2$. As such, the free end of the wire melted and converted into an axial spray of superheated alloy material upon entering the arc discharge. The spray was directed onto the submerged melt surface by the shielding gas. After adding an appropriate amount of lead wire to the bath of molten aluminum, the alloyed molten aluminum was continuously cast into several ingots having dimensions of 6 in.×6 in.×36 in.

From FIG. 3, those skilled in the art will appreciate that a dramatic increase in lead's dissolution rate (that is, the rate at which lead dissolved into the molten media) resulted when the spark cup immersion depth was increased from five to six inches. It will be noted that further increases in immersion depth did not seem to have much of an effect upon the dissolution rate. Similarly, in FIG. 4, it can be seen that actual recovery in percentages (i.e., the percentage of alloying material added which actually dissolved in the molten media) increased dramatically when the immersion depth was increased from four to six inches. Moreover, further increases in the immersion depth showed further increases in actual recovery; however, not nearly as dramatic as those that occurred from four to six inches. Actual recovery was measured by optical emission spectroscopy. Metallographic examination revealed that the particles of lead in the cast ingot were smaller, more acicular shaped and more uniformly sized and dispersed than those added by conventional methods. Moreover, it is believed that such ingot provided by the present invention has improved machinability.

While the immersion depth providing enhanced dissolution and dispersion in accordance with the present invention will vary with the material being added, bath size, bath flow rate, alloy feed rate and size, inter alia, and will have to be determined for each setup, those skilled in the relevant art will appreciate that the method and apparatus of the present invention can result in greatly increased dissolution rates, particularly for alloy materials with limited solubility, such as lead, bismuth and tin and for high oxidizable materials such as magnesium and zinc. Moreover, it is anticipated that actual recovery (i.e., the percentage of added alloying material which actually dissolves in the molten media being alloyed) should exceed 50% for most alloying materials. In fact, actual recoveries as high as 95%, such as that obtained with lead, should be attainable in most cases.

Those skilled in the art will also appreciate that the present invention is amenable to continuous casting processes. Continuous casting processes are those that permit the continual flow of metal from a melting furnace into a casting mold. Since continuous casting usually proceeds at a uniform rate, it will be easy to calculate the desired alloy feed rate with the method of the present invention. The invention, however, is particularly amenable to continuous casting processes wherein the casting rate varies. Suitable instrumentation can be installed on the casting line to detect any changes in the casting rate which can then be used to make adjustments in the alloy feed rate.

A useful embodiment of the invention concerns forming intermetallic particles such as $TiAl_3$, $Ni_3Al$ and other particles. The particles may be geometrically close packed intermetallics (GCP) or they may be topographically close packed (TCP) particles.

Particles such as titanium aluminide, nickel aluminide and other intermetallic particles are often used as reinforcing media to strengthen or otherwise enhance a metal matrix such as aluminum. The benefits of such are generally recognized but the cost of intermetallic particles is generally considered quite high and those cost factors can impede the usefulness of metal matrix composites so reinforced by intermetallic compounds in cost-sensitive applications. The present invention facilitates providing such intermetallic compounds at a reduced cost in comparison with such other methods commonly employed in producing those compounds such as vapor or chemical vapor disposition or reacting in a high temperature bath of substantial volume and solidifying. For instance, the production of nickel aluminide typically utilizes specialized induction heated furnaces capable of holding at 2800° F., an expensive operation at best whereas the present invention produces $Ni_3Al$ in a much less costly operation.

In practicing the invention, referring to FIG. 1, the molten media 12 may contain one or more constituents of said intermetallic compound and the material 10 fed to the chamber 22 can comprise another constituent of said intermetallic compound. For instance titanium aluminide ($TiAl_3$) can be formed by adding titanium rod 10 to chamber 22 in FIG. 1 immersed in a bath 12 of molten aluminum. The metallic titanium rod 10 is converted into a superheated spray, said spray including titanium vapor spray, and the introduced titanium reacts in the molten aluminum to form titanium aluminide ($TiAl_3$) in situ in the molten aluminum. It is believed that the extremely high plasma energy in the chamber 22 vaporizes substantial portions if not all of the titanium such that it forms a vapor spray or other suitable fine spray condition that is carried into the molten metal by the gas exiting chamber 22 into the molten media. Thus gas transport may be employed as a mechanism to enhance distribution of the ultrafine titanium spray into the molten aluminum to form titanium aluminide in situ in the molten aluminum. This provides an extremely fine and uniform distribution of the titanium in the molten aluminum for prompt reaction therewith to form a uniform dispersion of fine titanium aluminide particles in the molten aluminum. It is worth noting in this connection that plasmas typically reach core temperatures of approximately 50,000° F. whereas titanium vaporizes at around 5,930° F. It is to be appreciated that many metals commonly used in alloying vaporize below 10,000° F. (Cu 4,680° ; Ti 5,930° ; Zr 7,820° ; Nb 8,906° ; W 9,986° ; Ni 5,135° ; Mn 3,704° ; Al 4,440° ; Cd 2,715° ; Cr 4,790° ; Co 5,215° ; Pb 3,180° ; Li 2,426° ; Mg 2,040° ; Mo 8,720° ; Ta 9,800° ; Zn 1,665° ; Zr 7,910° ; Fe 5,225° ; all degrees F. and approximate). Accordingly, 50,000° F. typical plasma core temperatures are sufficient to vaporize or finely distribute such metals if this energy is properly harnessed and utilized as in the present invention. Part of this utilization is achieved by using a relatively small chamber such as depicted in FIG. 1 and a carrier gas which can be the ionizable gas used in forming the plasma, and preferably is said ionizable gas, so as to utilize the marked benefits of gas transport mechanisms to provide for greatly enhanced contact surfaces or condensation sites which, in the case of Ni in aluminum, provide for great multiplicities of reaction sites to produce multiplicities of nickel aluminide particles.

When referring to a constituent, such is intended to include an element or metal or ingredient or substance that goes into forming the intermetallic compound. The constituent is typically a metal such as nickel or titanium but could possibly be a compound including a fluid or gas compound. For instance, an aluminum rod could be introduced to the chamber 22 which has its discharge immersed in molten aluminum. Helium is provided as an ionizable gas and a plasma is formed as described herein. Methane, acetylene or other gaseous carbon source or even a solid carbon source is also provided to the plasma to form aluminum carbide, $Al_4C_3$. When referring to a constituent of an intermetallic compound or in referring to a constituent that is reactive to form said compound, what is intended herein is that the constituent be suited to such reaction and so suited in practicing the invention. For instance, titanium is not normally considered to be very reactive in molten aluminum. But it is known that titanium is capable of being reacted with aluminum under certain conditions such as those normally used in producing titanium aluminide. However, as just stated, merely inserting a rod of titanium into a molten aluminum bath is not going to effect this purpose in an efficient manner at normal aluminum processing temperatures of below 1500° F. and certainly not in any manner insofar as producing useful titanium aluminide particles. Nonetheless, in practicing the invention where the titanium is introduced into the plasma arc in accordance herewith and introduced and converted into a vapor or ultrafine spray, it is reactable in molten aluminum.

The process of the invention is considered useful to produce the number of intermetallic compounds employing one constituent in the form of a solid metal rod being provided as material 10 in chamber 22 shown in FIG. 1 and the other being provided as a molten metal bath into which the chamber 22 is immersed. The following table sets forth a listing of applications to which the present invention is considered useful:

TABLE I

| Intermetallic Compound | Molten Media | Metal Rod 10 |
|---|---|---|
| $Ni_3Al$ | Al | Ni |
| $FeAl_3$ | Al | Fe |
| $FeAl_3$ | Fe | Al |
| $CrNi_3$ | Ni | Cr |
| $MnNi_3$ | Ni | Mn |
| $W_2Fe_3$ | Fe | W |
| $CeFe_5$ | Fe | Ce |
| $VAl_3$ | Al | V |

In practicing the invention, the yield of intermetallic compound particles is increased by increasing the addition rate of material 10 into the chamber 22 and the plasma. The volume fraction of intermetallic particles can be quite high, 10% or 15% or 20% or more, such as fractions of 25 or 30% or more. Another consideration in increasing the yield is to keep the media moving past the chamber exit region so as to provide fresh media for reaction and remove intermetallic compounds formed at the discharge region. The size of the particles can be increased, if desired, by holding such at saturation conditions at the reaction temperature so as to increase reaction residence time. Intermetallic compound formation normally requires elevated temperature. For $TiAl_3$ the reaction temperature is about 665° C. (about 1230° F.). The enormous thermal energy of the plasma is helpful in heating the media or keeping it at a sufficient temperture to favor formation and growth of intermetallic compound particles.

After the intermetallic particles are formed, they can be separately recovered and this can be effected by filtration or centrifuging or possibly by dissolving in a suitable agent or by combinations of operations. Filtration or centrifuging recover the particles as an occluded mass. For instance, in making nickel aluminide in an aluminum matrix the particles are recovered with occluded aluminum. The recovered mass may be useful as is or further processing or separation steps such as dissolution of the occluded aluminum may be desired. For instance, in making titanium aluminide or nickel aluminide, sodium hydroxide is a useful means to dissolve excess aluminum and yield the particles since the sodium hydroxide will dissolve aluminum but not the intermetallic compound. In some cases, the particles are not separated but left in a metal media to provide a metal matrix reinforced with the particles.

Another embodieent of the invention uses feeding two or more constituents of the desired intermetallic compound to the chamber 22 for reaction there or in the media or both. For instance, a composite rod of Ti and Al could be fed to a chamber 22 in a magnesium bath.

In an example of the invention, an aluminum bath at 1320° F. was provided at 960 pounds per hour. A small chamber 22 was fed with 142 pounds/hour of ⅛-inch diameter nickel wire and helium gas. Current at 2300 amps (about 190,000 watts) was provided to the rod. A plasma is formed in the chamber 22 as a result of the foregoing and this resulted in producing about 165 pounds/hour of $Ni_3Al$ in the aluminum which was heated to a temperature exceeding 2400° F. by the process. The heating of the metal bath or media by the process of the invention is quite significant in producing intermetallic compounds and is an important benefit of the invention since formation and growth of intermetallic compound particles can be favored by relatively high temperatures. When the melt solidified approximately 17% of the mass was $Ni_3Al$ particles.

An embodiment of the invention utilizes a solid body of aluminum or other material in the furnace 14. The chamber 22 is initially positioned above or substantially at the upper surface 16 of said material and an arc is initialed and a plasma generated between rod or wire 10 and the aforesaid surface 16. This results in forming a pool of molten aluminum or other material and the chamber 22, lowered therein, functions with respect to that pool substantially in the general manner described hereinabove. Much the same applies to a particulate or lump charge in furnace 14 except that initially the chamber 22 can be initially positioned with its discharge below or within the upper level 16 of the body. These arrangements offer potential in using the plasma energy to help in melting in addition to alloying.

While the invention has been described in terms of preferred embodiments, the claims appended hereto are intended to encompass all embodiments which fall within the spirit of the invention.

What is claimed is:

1. A process for forming one or more intermetallic compounds comprising the steps:

(a) providing a chamber having a discharge opening positioned within a molten media;

(b) introducing into said chamber a gas comprising an ionizable gas under sufficient pressure to provide an interior molten media surface substantially at said chamber's discharge region;

(c) providing a plasma within said chamber, said plasma substantially extending at least from said interior molten media surface to a site within said chamber and spaced from said interior media surface; and (d) providing to said site within said chamber material comprising one or more constituents reactable with each other or with one or more constituents in said media, or both, to produce one or more intermetallic compounds and converting said material into superheated spray substantially within said plasma and carried toward said interior molten media surface.

2. A process for forming one or more intermetallic compounds comprising the steps:

(a) providing a molten media containing one or more constituents of said compound;

(b) providing a chamber having an open discharge positioned within a molten media;

(c) introducing into said chamber a gas comprising an ionizable gas under sufficient pressure to provide an interior molten media surface substantially at said chamber's discharge region;

(d) providing a plasma within said chamber, said plasma substantially extending at least from said interior molten media surface to a site within said chamber and spaced from said interior media surface;

(e) supplying to said site within said chamber a material comprising one or more constituents reactable with said one or more constituents in said molten media to produce one or more intermetallic compounds and converting said material into superheated spray substantially within said plasma an carried toward said interior molten media surface for reaction of one or more constituents of said compound in said media with one or more constituents in said material to form said compound or compounds; and (f) conducting a gas from said chamber into said media to aid entry into said media of substances from said chamber.

3. A process according to claim 1 wherein substantial heat is transmitted into the molten media from the chamber.

4. A process according to claim 1 wherein said gas is substantially introduced at a rate to aid entry into said molten media of substances from said chamber.

5. A process according to claim 1 wherein at least a portion of said material is supplied to said chamber means as an elongate solid.

6. A process according to claim 1 wherein the length of said chamber along the direction of projection into the molten media exceeds the transverse dimension of the chamber in the media.

7. A process according to claim 1 wherein said molten media is moving past the discharge of said chamber.

8. A process according to claim 1 wherein the media is agitated to further enhance dispersion within said media.

9. A process according to claim 1 wherein two or more constituents of said intermetallic compound are provided to said site in said step (d) thereof.

10. A process according to claim 1 wherein one or more constituents of said intermetallic compound are provided in said molten media and one or more constituents of said intermetallic compound are provided to said site in said step (d) thereof.

11. A process according to claim 1 wherein particles of said intermetallic compound are separated from at least some of the media.

12. A process according to claim 11 wherein said separated particles are treated to remove other substances therefrom.

13. A process according to claim 1 wherein said particles remain in said media to provide reinforcement therefor in a product comprising at least a portion of said particles and at least a portion of said media.

14. A process according to claim 2 wherein substantial heat is transmitted into the molten media from the chamber.

15. A process according to claim 2 wherein particles of said intermetallic compound are separated from at least some of the media.

16. A process according to claim 2 wherein said separated particles are treated to remove other substances therefrom.

17. A process according to claim 2 wherein said particles remain in said media to provide reinforcement therefor in a product comprising at least a portion of said particles and at least a portion of said media.

18. A process according to claim 10 wherein at least a portion of constituents provided to said site in said step (d) of claim 1 is provided as one or more fluids.

19. A process according to claim 2 wherein constituents in said material provided to said site in said step (e) react with other constituents in said material.

20. A process according to claim 1 wherein at least a portion of said material is supplied as a fluid.

21. A process according to claim 9 wherein at least a portion of said material is supplied as a fluid.

* * * * *